US005078033A

United States Patent [19]

Formon

[11] Patent Number: 5,078,033

[45] Date of Patent: Jan. 7, 1992

[54] FLEXIBLE SHEET MATERIAL DISPENSER

[75] Inventor: John S. Formon, Marietta, Ga.

[73] Assignee: Georgia-Pacific Corporation, Atlanta, Ga.

[21] Appl. No.: 611,260

[22] Filed: Nov. 13, 1990

[51] Int. Cl.[5] ..... B26D 1/56; B65H 35/08

[52] U.S. Cl. ..... 83/335; 83/336; 83/649; 225/14; 242/55.53

[58] Field of Search ..... 83/334, 649, 336, 335, 83/337, 660; 242/55.53; 225/106, 12-16

[56] References Cited

U.S. PATENT DOCUMENTS

| | | | |
|---|---|---|---|
| Re. 28,911 | 7/1976 | Jespersen et al. | 225/96 |
| 3,500,667 | 3/1970 | Jespersen | 70/84 |
| 3,575,328 | 4/1971 | Jespersen et al. | 225/2 |
| 3,851,810 | 12/1974 | Jespersen | 226/121 |
| 4,142,431 | 3/1979 | Jespersen | 83/335 |
| 4,206,858 | 6/1980 | DeLuca et al. | 225/96 |
| 4,404,880 | 9/1983 | DeLuca | 83/42 |
| 4,712,461 | 12/1987 | Rasmussen | 83/334 |
| 4,732,306 | 3/1988 | Jespersen | 225/2 |

*Primary Examiner*—Frank T. Yost
*Assistant Examiner*—Kenneth E. Peterson
*Attorney, Agent, or Firm*—Banner, Birch, McKie & Beckett

[57] ABSTRACT

A towel roll brake is not needed in this "grab and pull" dispenser to prevent the overspun towel from the roll from entering the nip region. An extra idler roll rests on the pinch roll and is counterrotated thereby, and any overspun web resting on the idler roll is kicked to the back of the dispenser. Fingers formed on the inside surface of the dispenser cover are positioned to derfine with the idler roll a gap which is only one-ply wide and through which the toweling must pass to reach the nip region, thereby preventing the overspun web from folding over onto itself. Without the brake tearing or "tabbing" of the soft towel in the user's (wet) hands as he pulls down on it is prevented.

31 Claims, 3 Drawing Sheets

FLEXIBLE SHEET MATERIAL DISPENSER

BACKGROUND OF THE INVENTION

The present invention relates to rolled flexible sheet material dispensers. It particularly relates to dispensers for dispensing today's soft paper toweling wherein the towelling is dispensed by the intending user grasping and directly pulling on the paper web.

Many designs for dispensers for rolled flexible sheet material, such as paper toweling and the like, are known. Examples of dispensers are shown in U.S. Pat. Nos. 3,575,328, Re. 28,911 ('911), 3,851,810, 4,142,431, 4,206,858, 4,404,880, 4,712,461 ('461) and 4,732,306 ('306), and in copending applications Ser. Nos. 07/175,255 ('255) and 07/427,336 ('336). The contents of each of these patents and applications and any other patents, applications or publications mentioned anywhere in this disclosure are hereby incorporated by reference in their enntireties.

Such dispensers are often located in public restrooms, and thus the intending users thereof with their wet hands do not want to touch any levers or buttons to actuate the dispenser. One dispenser design which addresses this problem is actuated by the user touching only the leading edge of the toweling, grabbing and pulling down on. For example, the '461 dispenser is especially adapted for creped paper toweling where the cutting mechanism is actuated solely by the user pulling on the paper web with his wet hands. A straight sliding knife inside of the feed roller is mounted so that the knife blade follows a path parallel to and offset from the radius of the feed roller. A camming mechanism imparts a reciprocating movement to the blade, as the feed roller is rotated, by drawing on the web of material exposed at the exit of the dispenser. After the blade has cut the web of material and the feed roller rotated further through its cycle, the edge of the blade is retracted into the feed roller. Small uncut portions of the web are spaced across the width of the web, and with only a minor small increase of pulling force supplied by the user, the separated uncut portions are torn and the user thereby effectively obtains the appropriate length of toweling. At the same time, a free length of web material is provided available and disposed beneath the dispenser exit ready for and accessible to the next user. Thus, by automatically exposing a lead length of towel web, the next intending user need not touch any part of the dispenser. In other words, a preselected length of the supply web is severed by the knife as the web is being withdrawn by the user, and a lead portion of the next sheet is automatically fed outside of the dispenser convenient to the next user.

A preferred toweling is today's soft toweling having better hand-feel and better absorption characteristics than towels in the past. These new towels are typically bleached white products and examples thereof are the ULTIMA soft towel available from Georgia-Pacific Corporation of Atlanta, Ga. and the SEQUEL towel available from Scott Paper Company of Philadelphia, Pa. Such toweling, however, is by its nature weak in the machine direction. This weak toweling, when pulled with the user's wet hands, tends to tear off or "tab" in the user's hands, which can be annoying to the user and wastes toweling.

A further example of a "towel grab and pull" type of dispenser is that shown in the '336 application as well as that of the ULTIMATIC dispenser which has been available from Georgia-Pacific for a one year or so. The latter is shown, for example, in a ULTIMATIC dispenser brochure entitled "The Ultimatic Towel Dispenser System and Ultima Towel." Drawing No. P-1201-144, dated August 1989, of Georgia-Pacific and entitled "ULTIMATIC Model P12", which brochure became publicly available a little more than a year ago, and shows dispenser components. With the ULTIMATIC dispenser having a close-coupled feedout spring, a pull of forty-four ounces during the end of the cut is required for a single-ply towel and a pull of over five pounds is needed for a double-ply paper.

To prevent the large towel roll within the dispenser, when the towel free end is pulled down hard, from overspinning and then getting caught in the rolls or cutting mechanism, towel roll brakes have been provided. One form of brake, as found on the ULTIMATIC dispenser for example, comprises an inwardly disposed, tapered trinagular rib on at least one towel support arm. The arm is spring loaded to keep pressure on the towel roll and to bias it against the opposite arm. The rib is larger at its outside base than at its point or tip at the center of the arm. When the roll is large in diameter, it has a greater mass and therefore requires a greater braking force. As it decreases in diameter, it becomes lighter and has less mass and thus does not need as much braking force. Other types of known dispenser towel roll brakes are a wire-hanging type of brake wherein the towel roll sits in a wire hanger that pivots and the towel roll rests against the back plate. An example of such a brake is found in the CORMATIC dispensers available from Georgia Pacific or those described in U.S. Pat. Nos. 3,500,667 and 3,575,328. Another form includes an auxiliary, small idler roller that is spring loaded and rests on the towel roll to provide the braking force, such as is provided in various dispensers.

SUMMARY OF THE INVENTION

Accordingly, a principal object of the present invention is to provide an improved flexible sheet material dispenser.

Another object of the present invention is to provide an improved dispenser for dispensing today's softer paper toweling such that tabbing or premature tearing of the toweling is less of a problem.

A further object of the present invention is to provide an improved paper towel dispenser wherein overspun web in the dispenser cabinet is not a problem.

A further object of the present invention is to provide an improved toweling dispenser requiring less pull force on the toweling to dispense and cut an individual length of toweling.

Directed to achieving these objects, a dispenser for cutting and dispensing flexible sheet material, such as soft paper toweling, off of a roll is herein provided. The material is hand pulled off of the roll and cut in individual lengths by a knife roll in the dispenser cabinet. The roll has little or no braking action, to prevent tearing of pieces off of the wet soft toweling ("tabbing"), and thus overspinning of the sheet material within the dispenser can occur. To prevent the overspun material from jamming or folding in the dispenser, an extra roller is built therein and rests on and is counterrotated by the spring-loaded drive roller. Any overspun web on the roller will thereby be kicked out of the way to the back of the dispenser. A pair of spaced fingers are molded to the cover and define with the roller a gap therebetween through which the sheet material passes to be dispensed. The gap is only one-ply thick or wide, however, thereby preventing any downstream jamming of the overspun material. Pulling of the toweling is easier since the user is often working off the overspun material in the cabinet and not actually further rotating the roll. A lead length of toweling web is automatically fed out for access to the next user after a length has been pulled and cut off by the prior user.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS

Figure 1:
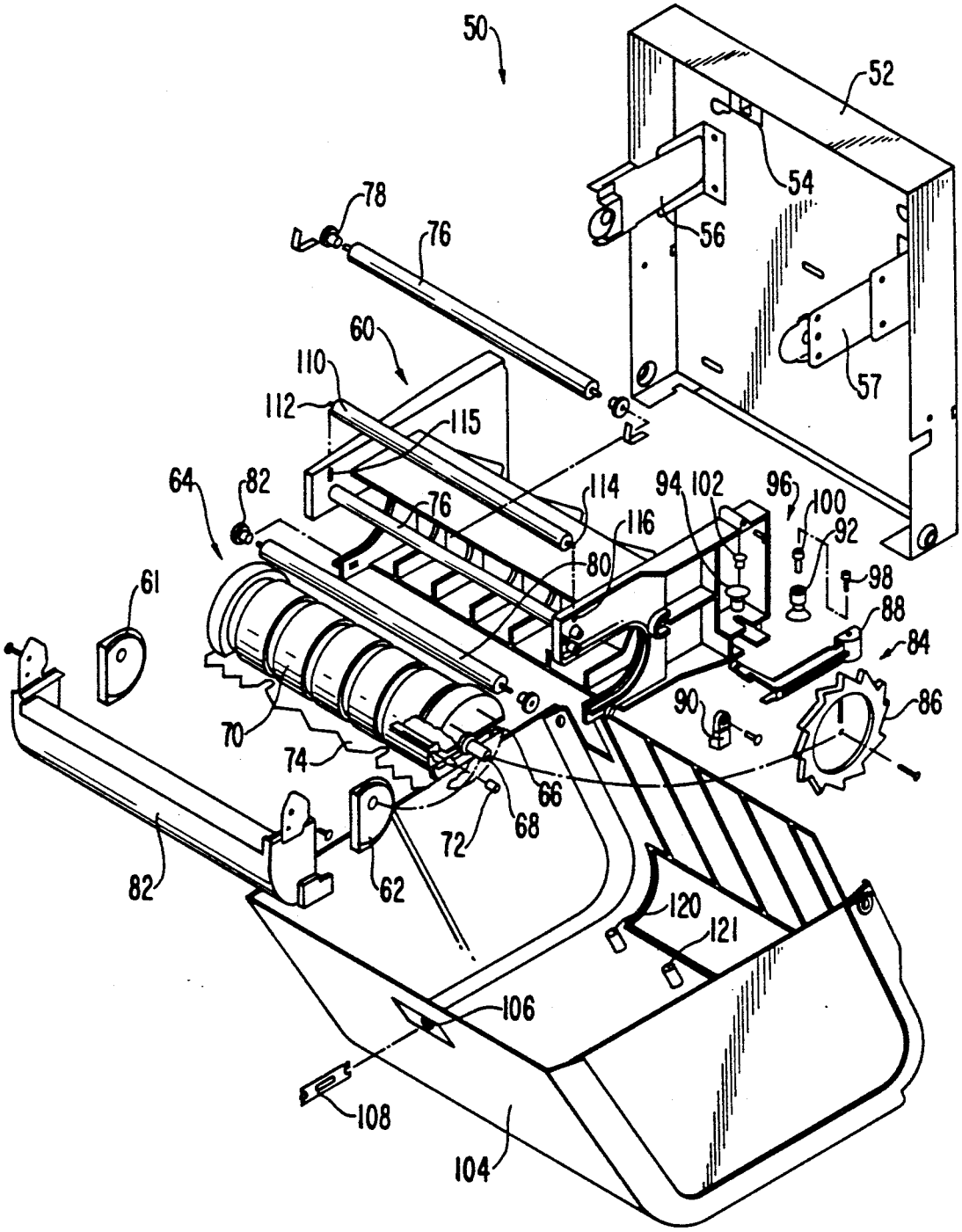
FIG. 1 is an exploded perspective view of a dispenser of the present invention.
Figure 2:
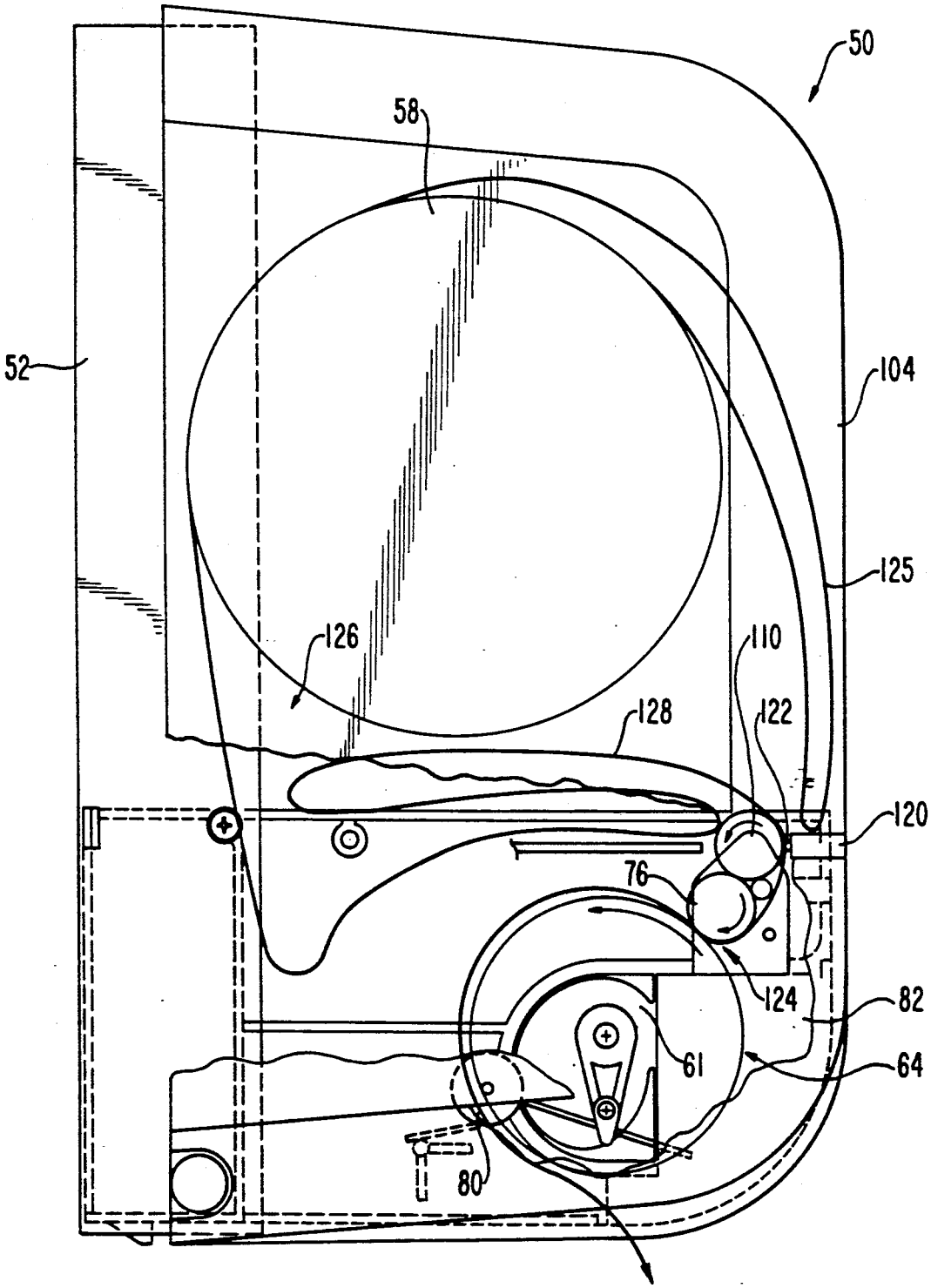
FIG. 2 is a side elevational view of the dispenser of FIG. 1.
Figure 3:
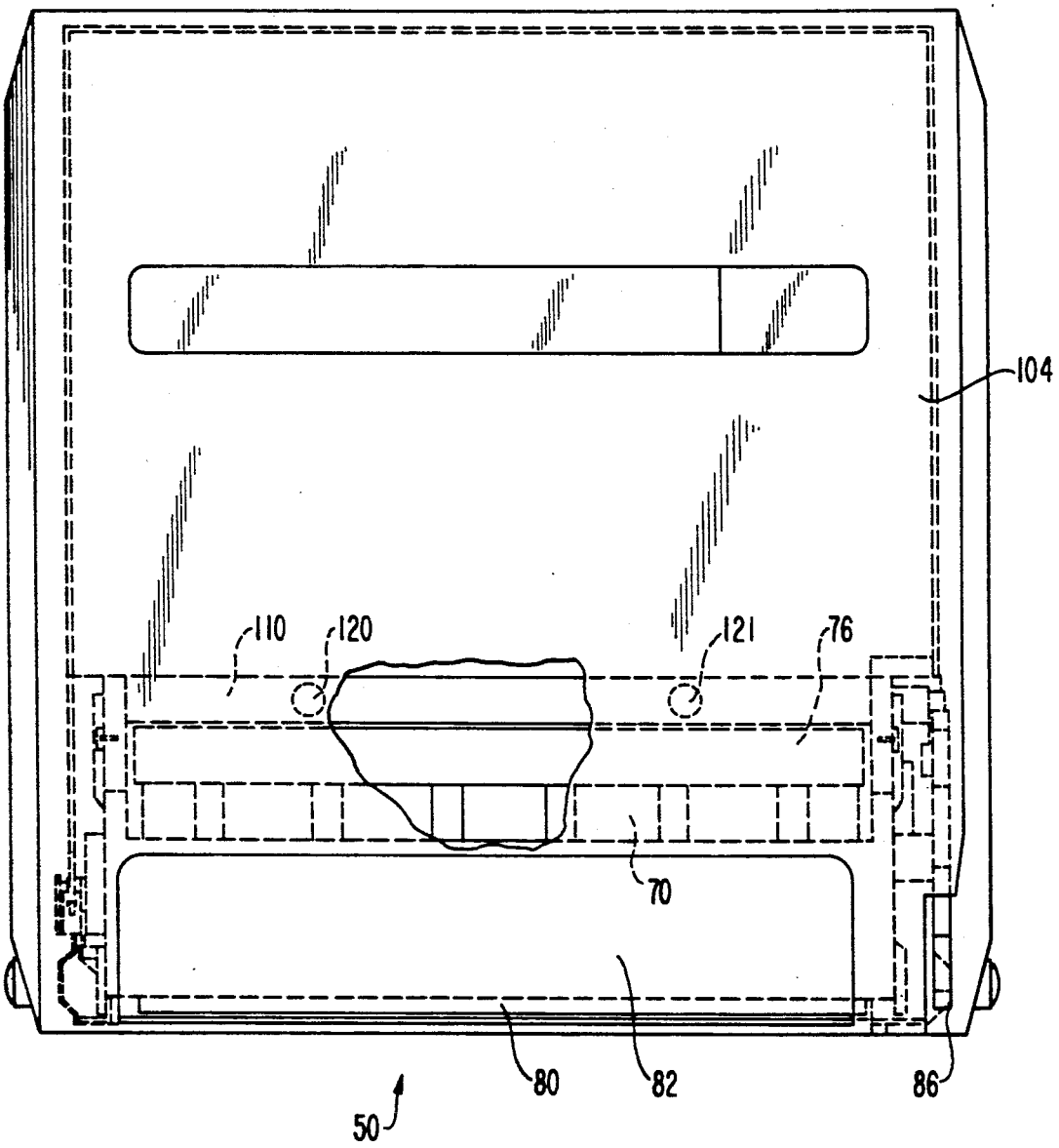
FIG. 3 is a front perspective view of the dispenser of FIG. 1.

Referring to the drawings, a rolled material dispenser of the present invention is shown generally at 50. The dispenser 50 includes a back plate 52 mountable against a wall or other support surface so that the paper toweling or other webbed material therein is convenient for intending users. A strike plate 54 depends downwardly from the front of the top lip of the back plate. Welded or riveted (spring-biased) roll mount assemblies or arms 56, 57 are attracted to the back plate at upper inside locations to rotatably support the roll of webbed material 58. The roll of webbed material 58, which is best shown in FIG. 2, is rotatably secured to and in the housing 60 by left and right cam chocks 61, 62. A front corner portion of the feed roll 64 of the dispenser 50 is broken away in FIG. 1 to illustrate internal components thereof. The feed roll 64 includes a bottom roll 66, a top roll 68, feed roll tires 70, a pair of cam follower rollers 72 and a carriage knife 74. The knife 74 is movable with respect to the feed roll tires 70 in a controlled cutting motion. Details of the mounting and operating mechanism of cutting knives (74) are disclosed, for example, in the '416 patent and in the '336 application.

An upper pinch roller 76 is attached via pinch roller bushings 78. The web of material passes by the upper pinch roller 78, the feed roller 64 and then by the lower pinch roller 80, whose design effectively grips the towel material thereby eliminating premature breakoffs of the toweling material. The lower pinch roller 80 is similarly secured by lower pinch roller bushings 82 attached to the pinch roller shaft. Operation of exit or lower pinch rollers (80) is described, for example, in the '155 and the '336 applications. Thus, the web withdrawn from the roll 58 is threaded clockwise around the upper pinch roller 76 which is biased by upper pinch roller springs, clockwise around the rear side of the feed roll 64, and counterclockwise over the exit pinch roll 80. A stripper bar 82 is securable to the housing 60, generally in front of the feed roll 64, and is provided for stripping the towel from the knife roller.

A stop mechanism shown generally at 84 includes a feed wheel 86 driven by the towel wed being pulled from the dispenser 50, a stop lever 88 and a pawl anti-reversing member 90. The stop mechanism 84 abruptly stops the rotation of the feed roll 64 so that individual sheets of paper toweling can be torn from the web along the perforations just made by the knife 74. The operation of dispenser feed wheels (86) is explained further in the '306 patent. This stop mechanism 84 allows a positive stopping while absorbing kinetic energy, thereby enhancing the life of the dispenser 50.

Upper and lower stationary and moving vacuum cups 92, 94 of a cup assembly shown generally at 96 and controlled by a needle valve 98 act as a stopping device to absorb kinetic energy. The operation of a vacuum cup timing assembly (96) is disclosed, for example, in the '336 application. The '911 reissue patent discloses the use of vacuum cup timers to provide a time delay between the withdrawal of individual towel sheets to thereby reduce waste of the web material. The cup assembly 96 further includes a valve body mechanism 100 and a valve cup stud 102. The assembly 96 is associated with the stop mechanism 84 to regulate the length of time during which the stop mechanism is effective for preventing rotation of the feed roll 64. The needle valve 98 controls the flow of air into the vacuum environment between the vacuum cups 92, 94 to regulate the period of time during which the cups remain in a vacuum-gripping relationship, arresting further rotation of the feed wheel 86 and the associated feed roll 64. after the vacuum-gripping relationship has been destroyed by the entry of air between the cups 92, 94, the stop lever 88 releases the spring bias cam, the feed roll tires 70 and the feed wheel 86.

With the roll of web material 58 inserted and held in the roll mount assemblies and the free end of the material wound around the upper and lower pinch rollers and 76, 80 and the feed roll 64, the cover 104, which is pivoted at the bottom to the back plate 52, is then pivoted upward, snapped into place and thereby protects the internal components of the dispenser 50. When needed for replacement of the roll towel or servicing of the dispenser components, the cover 104 can be opened by unlocking the lock 106 with a key 108.

An additional idler roller 110 provided in this dispenser has its axle ends 112, 114 rotating in slots 115, 116 in the housing 60 and rests on or is supported by the drive roll, that is, the upper pinch roller 76. Thus, as the drive roll 76 is rotated in a clockwise direction, as can be understood from FIG. 2, the idler roller 110 is thereby rotated in a counterclockwise direction. As previously, mentioned the pinch roller 76 is spring loaded against the knife roller 64, which contains the knife 74 that cuts the paper. The pinch roller 110, on the other hand, is not spring loaded but merely rides on the pinch roller 76. The pinch roll 110 is rotated, when the toweling is pulled down, via the pinch roll 110, which helps in the cutting action. This is a "no hands" capacity, meaning that the dispenser 50 does not have a lever or a crank; the user simply grabs the towel and pulls down on it to dispense and cut a towel length.

Mounted to the inside of the cover 104 is a pair of fingers 120, 121 approximately four inches apart and lying in the same horizontal plane as that of the axis of the idler roller 110, as can be appreciated from FIG. 2. In other words, they are positioned precisely on the center line of the roller 110. The fingers 120, 121 which are molded to the inside front surface of the cover 104, are precisely positioned and dimensioned to define with the idler roller 110 and therebetween a gap 122 which is approximately only thirty to forty thousandths of an inch thick or essentially the thickness of only a single ply of toweling material. (In the general location of the fingers in the prior art ULTIMATIC dispensers was a horizontal cylinder with a little nib at its left end which acted as a protecting device and kept any overspun web from falling down the front of the inside of the cover and getting caught up in the pinch roll. This cylinder arrangement is not provided herein in dispenser 50.)

A braking mechanism for braking the spin of the towel roll 58 need not and preferably is not provided in this dispenser 50. Thus, overspinning of the material can occur when the web is pulled by the user. The overspun web material, instead of jamming the dispenser 50 as being caught in the nip region 124 thereof, collects in the overspun web area shown generally at 126 of the dispenser upstream of the idler roller. Only a single ply of the toweling from this area 126 can pass through the gap 122 and eventually to the intending user. Since the idler roller 110 rotates counterclockwise or towards the back of the dispenser 50, any overspun web resting on it is kicked to the back of the dispenser 50, to area 126. This prevents the roller 76 from taking the overspun web and pulling it into the cutting mechanism (74). Such a pulling action of the overspun web could result in excessively long sheets of material being dispensed or in sheets folded over onto themselves and passing through the cutting mechanism.

The overspun web is thus advantageously controlled in two ways. One way is that the upper roller 110, together with the fingers 120, 121, define an extremely small gap 122 allowing only one ply of towel to pass therethrough. Another way is that as the upper pinch roll 110 counterrotates, any overspun web resting on it is kicked away towards the back of the cabinet 50. Only one ply can thus be fed through the dispenser at any one time. The fingers 120, 121 prevent any overspun web 125 from falling past rolls 76, 110 down into the nip area 124 or the area where the towel would be sucked in by the cutting mechanism (74). Any overspun web that is not kicked back and that comes down the inside front of the cover of the dispenser 50 rests on the fingers 120, 121 and does not fall down into the nip region 124.

Thus, overspinning is controlled and there is no need for a brake on the towel roll 52. The towel roll 52 can simply overspin as it is being pulled on, and by eliminating the brake, the extra pull force required by a person pulling the towel out is eliminated. This overspun collection also has an advantage. This is because the user is then often working off of the free (overspun) web 128 laying in the cabinet in area 126 and does not need to rotate the towel roll 58, thereby allowing an easier pull. Since it is an easier pull, the previously experienced tabbing problem is further minimized and lower amounts of towel sheet integrity are needed.

Although a preferred embodiment of the present invention is a modified ULTIMATIC dispenser 50, as described and illustrated herein, the inventive concept of the present invention can be adapted for use in any number of types of dispensers. Examples thereof include those disclosed in U.S. Pat. Nos. 4,203,562, 4,307,638 and 4,487,375 and in the '911 and '461 patents. In fact, this invention can be used on generally any dispenser (50) that uses no brake-on the towel roll (58) therein to prevent overspinning or any dispensers that have an overspun web even if their towel roll does utilize a brake.

Thus, a simple method of controlling the overspun web in a flexible sheet material dispenser 50 is herein provided. The spun web material, as from a hard wound roll towel 58, can collect (128) when the brake on the roll is removed to decrease drag and overall force required to dispense the material. In other words, when the brake is removed or omitted, the roll 58 is able to freely spin, which can create free web material in the dispenser 50. When the brake is removed entirely, the dispensing forces are lower, thereby decreasing tabbing and increasing the spit-out or automatic feed length of the toweling. This overspun web material is effectively controlled by this dispenser 58 to prevent its passage into the nip area 124, by providing a unique guide roller 110 and finger assembly 120,121. The guide roller's rotation kicks any web material (128) thereon away from the nip 124 and to the back of the cabinet 50 to area 126, preventing more than one ply material from entering the nip. The fingers 120,121 are closely positioned to the guide roller 110 to ensure no more than one ply of material which must pass through the gap 122 thereby defined enters the nip. Even though overspun web collects the "kick back" (126) and the "gap" (122) thus allow only one ply to be fed through the dispenser 50 at a time. An easier pull and elimination of the tabbing problem result.

From The foregoing detailed description, it will be evident that there are a number changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A flexible sheet material dispenser, comprising:

a dispenser cabinet;

holding means for holding a roll of flexible sheet material in said cabinet such that the roll can rotate within said cabinet and overspin as a user hand pulls a free end of the sheet of material therefrom;

a roller positioned in said cabinet;

gap means for defining with said roller and therebetween as essentially one-ply wide sheet material gap through which sheet material from the held roll passes;

cutting means for cutting a length of sheet material hand pulled off of the held roll and passing through the gap; and counterrotating means for counterrotating said roller such that at least some of the time when an overspun web of sheet material, before passing through the gap, rests on said roller the resting web is kicked generally away from the gap.

2. The dispenser of claim 1 wherein said cabinet defines therewithin a dickback area into which said roller kicks the resting web.

3. The dispenser of claim 2 wherein said kickback area is generally below the held roll.

4. The dispenser of claim 2 wherein said kickback area is generally to one side of the held roll.

5. The dispenser of claim 4 wherein said kickback area is also generally below the held roll.

6. The dispenser of claim 1 wherein said cabinet includes an elongated opening downstream of the gap and out through which the free end of the sheet material off of the held roll passes, accessible for user hand pull.

7. The dispenser of claim 7 wherein said elongated opening is downstream of said cutting means.

8. The dispenser of claim 1 wherein said counterrotating means rotates said roller in a counterclockwise direction.

9. The dispenser of claim 1 further comprising nip means for defining at least in part a nip area through which the one-ply wide sheet material passes after passing through the gap and before being cut by said cutting means.

10. The dispenser of claim 9 wherein said counterrotating means kicks the resting web away from the nip area.

11. The dispenser of claim 1 wherein said counterrotating means kicks the resting web to the back of said cabinet.

12. The dispenser of claim 1 wherein said cabinet includes a cover, and said gap means is mounted on said cover.

13. The dispenser of claim 12 wherein said cover is pivotably positionable between a normal closed position and an open position wherein the held roll is accessible, and said gap means is movable therewith.

14. The dispenser of claim 12 wherein said gap means comprises a plurality of spaced finger members secured to an inside surface of said cover.

15. The dispenser of claim 14 wherein said finger members comprise first and second horizontally spaced finger members.

16. The dispenser of claim 12 wherein said gap means is molded to said cover.

17. The dispenser of claim 1 wherein said roller is rotatable by said counterrotating emans about a horizontal axis.

18. The dispenser of claim 1 wherein said gap means is positioned in the same horizontal plane as that of said roller.

19. The dispenser of claim 1 further comprising a mechanism housing disposed in said cabinet and defining a pair of spaced slots in which axle ends of said roller rotate.

20. The dispenser of claim 1 wherein said counterrotating means includes a drive roll which when rotated drives said roller.

21. The dispenser of claim 20 wherein said drive roll frictionally drives said roller along generally the length thereof.

22. The dispenser of claim 20 wherein said roller rests with its weight on said drive roll.

23. The dispenser of claim 20 wherein said drive roll comprises a spring-loaded roller.

24. The dispenser of claim 20 wherein said cutting means comprises a knife roll, and said knife roll and said drive roll define a toweling nip region therebetween.

25. The dispenser of claim 24 wherein said drive roll is spring-loaded against said knife roll.

26. The dispenser of claim 1 wherein said cutting means includes a cutting mechanism and a nip region immediately upstream of said cutting mechanism, and said counterrotating means prevents overspun web from the held roll from entering said nip region.

27. The dispenser of claim 1 wherein said counterrotating means includes a spring-loaded sheet material pinch roller.

28. The dispenser of claim 1 wherein said counterrotating means rotates said roller when and only when a user is pulling on the free end of the sheet material.

29. The dispenser of claim 27 wherein said cutting means comprises a knife roll rotatably disposed in said cabinet.

30. The dispenser of claim 1 wherein said roller comprises an idler pinch roller, and said counterrotating means rotates said idler pinch roller in the direction opposite to a feed direction of the sheet material from the held roll.

31. The dispenser of claim 1 further comprising feed-out means for feeding, a short time after a length of sheet material has been cut by said cutting means, a lead length of the sheet material from said dispenser so as to be accessible to the next user.

* * * * *

UNITED STATES PATENT AND TRADEMARK OFFICE
CERTIFICATE OF CORRECTION

PATENT NO. : 5,078,033

DATED : January 7, 1992

INVENTOR(S) : John S. Formon

It is certified that error appears in the above-identified patent and that said Letters Patent is hereby corrected as shown below:

Column 1, line 20, delete "enntireties" and insert --entireties--.

Column 2, line 19, delete "trinagular" and insert --triangular--.

Column 3, line 34, delete "attracted" and insert --attached--.

Column 3, line 66, delete "wed" and insert --web--.

Column 4, line 26, delete "after" and insert --After--.

Column 4, line 38, delete "roll towel" and insert --towel roll--.

Column 4, line 48, delete "," after "previously" and insert --,-- after "mentioned".

Column 4, line 34, delete "and 76," and insert --76 and--.

UNITED STATES PATENT AND TRADEMARK OFFICE

CERTIFICATE OF CORRECTION

PATENT NO. : 5,078,033

DATED : January 7, 1992

INVENTOR(S) : John S. Formon

It is certified that error appears in the above-identified patent and that said Letters Patent is hereby corrected as shown below:

Column 6, line 43, delete "as" and insert --an--.

Column 6, line 55, delete "dickback" and insert --kickback--.

Column 6, line 67, delete "7" and insert --6--.

Column 7, line 12, insert after "wherein" --said cabinet has a cabinet back and--.

Column 7, line 31, delete "emans" and insert --means--.

Signed and Sealed this

Fourth Day of May, 1993

*Attest:*

Michael K. Kirk

MICHAEL K. KIRK

*Attesting Officer*

*Acting Commissioner of Patents and Trademarks*